US007727301B2

(12) United States Patent
Shaw

(10) Patent No.: US 7,727,301 B2
(45) Date of Patent: Jun. 1, 2010

(54) MICROWAVE TREATMENT OF MINERALS

(75) Inventor: Raymond Walter Shaw, Carlton North (AU)

(73) Assignee: Technological Resources Pty. Limited, Melbourne (AU)

( * ) Notice: Subject to any disclaimer, the term of this patent is extended or adjusted under 35 U.S.C. 154(b) by 0 days.

(21) Appl. No.: 11/664,165

(22) PCT Filed: Sep. 30, 2005

(86) PCT No.: PCT/AU2005/001499

§ 371 (c)(1),
(2), (4) Date: Feb. 15, 2008

(87) PCT Pub. No.: WO2006/034553

PCT Pub. Date: Apr. 6, 2006

(65) Prior Publication Data

US 2009/0013822 A1 Jan. 15, 2009

(30) Foreign Application Priority Data

Sep. 30, 2004 (AU) ..... 2004905666

(51) Int. Cl.
*C22B 9/22* (2006.01)

(52) U.S. Cl. ..... 75/10.13; 204/157.43; 423/625

(58) Field of Classification Search ..... 75/10.13; 266/177

See application file for complete search history.

(56) References Cited

U.S. PATENT DOCUMENTS

| | | | | |
|---|---|---|---|---|
| 3,528,179 | A | 9/1970 | Smith | |
| 4,967,486 | A | 11/1990 | Doelling | |
| 5,408,074 | A * | 4/1995 | Warmbier et al. | 219/701 |
| 7,476,829 | B2 * | 1/2009 | Kingman | 219/695 |
| 2003/0029944 | A1 * | 2/2003 | Flinn et al. | 241/1 |
| 2004/0149649 | A1 * | 8/2004 | Uchiyama | 210/600 |
| 2004/0258591 | A1 * | 12/2004 | Birken | 423/150.6 |

FOREIGN PATENT DOCUMENTS

| | | |
|---|---|---|
| CA | 2277383 | 7/1999 |
| WO | WO 98/005418 | 2/1998 |
| WO | WO 03/072835 | 9/2003 |
| WO | WO 03/083146 | 10/2003 |
| WO | WO 03/102250 | 12/2003 |

OTHER PUBLICATIONS

Derwent Acc-No. 2003-779457 abstract for patent family WO 03083146 A1, published Oct. 9, 2003.*

* cited by examiner

*Primary Examiner*—George Wyszomierski
*Assistant Examiner*—Tima M McGuthry-Banks
(74) *Attorney, Agent, or Firm*—The Webb Law Firm

(57) ABSTRACT

A method and an assembly for treating minerals using microwave energy are disclosed. The method includes exposing a moving bed, preferably a mixed moving bed, of mineral particles to pulsed high energy microwave energy so that at least substantially all particles receive at least some exposure to microwave energy.

8 Claims, 1 Drawing Sheet

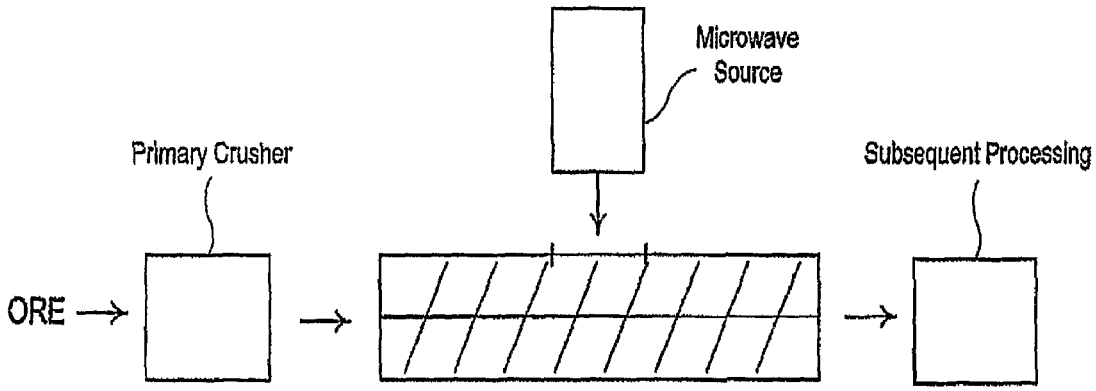
Microwave
Source
Primary Crusher
Subsequent Processing
ORE

MICROWAVE TREATMENT OF MINERALS

The present invention relates to microwave treatment of minerals.

The present invention is concerned generally with using pulsed high energy microwave energy to cause physical and chemical changes in the minerals.

The term "microwave energy" is understood herein to mean electromagnetic radiation that has frequencies in the range of 0.3-300 GHz.

The term "high energy" is understood herein to mean values substantially above those within conventional household microwaves, ie substantially above 1 kW.

The present invention is based on the realisation that effective and efficient treatment of minerals can be achieved by moving a bed, preferably a moving mixed bed, of minerals in particulate form through an exposure zone of a pulsed beam of high energy microwaves so that all of the mineral particles are exposed at least once to the microwave energy. In particular, the applicant has realised that the use of a moving bed, preferably a moving mixed bed, of mineral particles makes it possible to achieve required exposure of all particles and that the apparatus design can be much simpler than prior art proposals such as exposing free-falling particles to microwave energy in a single pass through an exposure zone.

According to the present invention there is provided a method of treating minerals using microwave energy that includes exposing a moving bed of mineral particles to pulsed high energy microwave energy so that at least substantially all particles receive at least some exposure to microwave energy.

As indicated above, the use of the moving bed of particles within the apparatus simplifies the design of the treatment apparatus.

In addition, an advantage of the moving bed is that it allows treatment of a much wider range of particles sizes, including larger particles. In particular, the moving bed overcomes some of the difficulties encountered in treating fine materials such as talc or materials where it is difficult to prepare a uniform sized material to feed to a microwave exposure zone or zones.

Preferably the moving bed is a moving mixed bed.

The term "moving mixed bed" is understood to mean a bed that mixes particles as particles move through a microwave exposure zone or zones and thereby changes positions of particles with respect to other particles and to the microwave energy as the particles move through the zone or zones.

The term "substantially all particles" is understood to mean 80% by weight of the particles.

Preferably the method includes exposing the moving bed of mineral particles to pulsed high energy microwave energy so that at least 85%, more preferably at least 90%, of the particles receive at least some exposure to microwave energy.

Preferably the energy of the microwave energy is at least 20 kW.

More preferably the energy of the microwave energy is at least 50 kW.

Preferably the duration of the pulses of the microwave energy is less than 1 second.

More preferably the pulse duration is less than 0.1 seconds.

The pulse duration may be less than 0.01 seconds.

The use of pulsed microwave energy minimises the power requirements of the method and maximises thermal cycling of the ore particles.

Preferably the method includes controlling the energy and/or the duration of the pulses of microwave energy to ensure that individual particles are not overly exposed leading to undesirable heating of particles and/or the apparatus.

Undesirable heating may include, for example, undesirable sintering/fusion of particles and/or heat damage to the apparatus.

Preferably the time period between successive pulses of microwave energy is 10-20 the times the pulse time period.

As indicated above, the present invention is not confined to operating with fine particles and, by way of example, particles in the range of 5-15 cm in a major dimension may be treated.

The FIGURE shows a schematic of an assembly for moving a bed of minerals through a microwave exposure zone according to one aspect of the invention.

According to the present invention there is provided an assembly for treating minerals using microwave energy that includes:

(a) a source of pulsed high energy microwave energy; and (b) an apparatus for moving a bed, preferably a mixed bed, of mineral particles through an exposure zone or zones of the microwave source so that, in use, at least substantially all particles receive at least some exposure to microwave energy.

The moving bed apparatus may be of any suitable type of apparatus.

By way of example, the moving bed apparatus may be a fluid bed apparatus.

The fluid bed apparatus may be a circulating or a non-circulating fluid bed.

By way of further example, the moving bed apparatus may be any apparatus that includes a screw or other suitable feed arrangement that moves particles at a controlled rate of movement forward from an inlet to an outlet end.

One example of a screw feed apparatus includes a cylindrical housing having an inlet at one end and an outlet at the other end and a screw feeder located in the housing for rotational movement about an axis of the screw to transport particles through the housing from the inlet to the outlet.

Preferably at least one section of the housing is formed from a material that is transparent to microwave energy.

It is also preferred that the section of the screw feeder located in the housing be formed from a material that is transparent to microwave energy.

The screw feeder apparatus makes it possible to effectively control the exposure of the minerals to microwave energy and, more particularly, to ensure that there is uniform treatment of the minerals.

Control may be achieved by adjusting one or more of the rate of rotation of the screw feeder, the energy of the pulsed microwave energy, the duration of the pulses, the time period between pulses, and the packing density of minerals in the housing.

The moving bed apparatus may be such that the pulsed high energy microwave energy is exposed directly to the moving bed of particles and does not include a housing such as the above-described cylindrical housing for the screw feed apparatus. In such situations, preferably the moving bed apparatus is designed to avoid dust flow back into the microwave source.

The moving bed apparatus may be vertical, horizontal or on an angle as there is no special need to use the fall speed to control exposure such as is the case in a prior art arrangement disclosed in Canadian patent application 2,277,383 in the name of Golden Wave Resources Inc.

The pulsed high energy microwave energy treatment method in accordance with the present invention is suitable for use in a wide range of applications in which it is desirable to facilitate and/or simplify subsequent processing of minerals.

The subsequent processing includes, by way of example, recovery of valuable components from minerals.

Accordingly, the present invention provides a method of recovering valuable components, such as a metal, from a mineral that includes the steps of:

(a) treating minerals in accordance with the above-described treatment method and producing treated minerals; and (b) processing the treated minerals and recovering one or more than one valuable component from the treated minerals.

One, although not the only, example of the use of the pulsed high energy microwave energy method in accordance with the present invention that facilitates and/or simplifies subsequent processing of minerals is to cause physical and chemical changes in minerals resulting in conversion of at least a part of the minerals to a gas phase and subsequent release of the gas phase from the minerals.

This example includes using pulsed high energy microwave energy to cause physical and chemical changes, specifically conversion of chemically-bound water in minerals to water vapour, and subsequent release of the water vapour from minerals.

Bauxite is one, although not the only, mineral where this example is of interest.

This example also relevant to other minerals, for example, iron ores, particularly goethite containing ores, and nickel-containing laterite ores.

Other examples of the use of the pulsed high energy microwave energy method in accordance with the present invention that facilitates and/or simplifies subsequent processing of minerals include:

(a) reaction of pyrite in ores such as talc to change it to pyrrotite which can then be selectively removed using magnetic separation as it is much more magnetic than pyrite and other minerals present;

(b) reaction of sulphides such as chalcopyrite to slightly change their chemistry to improve their subsequent separation through attachment of chemicals in flotation processing;

(c) reaction of sulphides such as chalcopyrite to change their chemistry sufficiently to make them more reactive in leaching but without causing significant generation of sulphur containing gases such as sulphur dioxide or hydrogen sulphide which would need capture and treatment within the process;

(d) reaction of carbon-containing impurities in ores such as talc or bauxite to remove them from the minerals and thus avoid harmful effects such as contaminating Bayer plant process streams and/or being detrimental to product properties such as the brightness of talc products;

(e) vermiculite exfoliation; and (f) causing selective cracking of ores to facilitate further processing such as is described and claimed in International Application Publication WO 2003/102250 in the name of the applicant, the disclosure of which is incorporated herein by cross-reference.

Example (f) above includes causing physical changes in ores to cause the ores to develop cracks through the differential heating caused by the microwave pulses such that subsequent processing is enhanced.

Example (f) above also includes causing cracking that is sufficient that many of the particles become fragmented allowing separation of those that have broken from those that were not affected by the microwaves because of their different size.

Example (f) above also includes causing cracking to occur selectively within the ores such that the valuable minerals are exposed at the surfaces of the cracks and can be more readily accessed in processes such as leaching and/or after further breakage by flotation.

Another, although not the only other example of subsequent processing of minerals in accordance with the present invention includes measuring the amount of material in minerals that is selectively heated on exposure to microwave energy.

Accordingly, the present invention provides a method of measuring the amount of heat sensitive material in a mineral that includes the steps of:

(a) treating minerals in accordance with the above-described treatment method; and (b) measuring the amount of material in the minerals that is selectively heated by exposure to microwave energy.

Another, although not the only other example of subsequent processing of minerals in accordance with the present invention includes separating material from minerals on the basis of heating selectivity.

Accordingly, the present invention provides a method of separating heat sensitive material in a mineral that includes the steps of:

(a) treating minerals in accordance with the above-described treatment method and selectively heating material in the minerals; and (b) sensing heated material and selectively separating the material from the minerals.

The present invention is described further by way of example with reference to the accompanying flow sheet that illustrates processing of bauxite ore in a method of treating the ore to facilitate or simplify recovery of alumina from the ore.

Bauxite is the major source of aluminium-containing ore used in the production of alumina. Bauxite contains hydrated forms of aluminium oxide (alumina) that occur in several different structural forms. Most commercially useful deposits of bauxite include gibbsite (alumina trihydrate) and/or boehmite (alumina monohydrate) and/or diaspore. Bauxite has considerable amounts of chemically-bound water. Typically, gibbsite has 35 wt. % water, boehmite has 15 wt. % water, and diaspore has 15 wt. % water.

The removal of water from bauxite is necessary as part of the recovery of alumina from bauxite.

The removal of part of the water by means of the use of high energy pulsed microwave energy in accordance with the present invention may also assist in improving the dissolution behaviour in later stages and allow dissolution at lower temperature such as has been found to occur with flash calcination in conventional furnaces.

With reference to the flow sheet, bauxite is supplied to a primary crusher and is crushed to a particle size, typically below 5 mm.

Thereafter, the crushed bauxite ore particles are supplied to a microwave treatment assembly. The assembly includes a source of high energy microwaves and an apparatus for moving a moving mixed bed of crushed bauxite ore particles past an exposure zone for the microwaves.

The microwave source produces pulses of high energy microwaves, typically at least 20 kW for pulse lengths of less than 0.01 seconds with time periods of 10-20 times the pulse duration between successive pulses.

The moving mixed bed apparatus is in the form of a screw feed apparatus that includes a horizontally or slightly inclined cylindrical housing having an inlet at one end and an outlet at the other end and a screw feeder located in the housing and arranged for rotational movement about an axis of the screw to transport particles through the housing from the inlet to the outlet.

The screw feed apparatus and the microwave source are positioned with respect to each other so that a beam of microwaves from the microwave source contacts a section of the cylindrical housing and exposes crushed bauxite ore particles in the exposure zone to the microwave energy. This section of the housing is formed from a material that is transparent to microwave energy. In addition, the section of the screw feeder located in the housing is formed from a material that is transparent to microwave energy.

In use, the rotational movement of the screw moves crushed bauxite ore particles in a controlled forward path of movement from the inlet end to the outlet end of the housing and, in so doing, moves the particles through the exposure zone for the pulsed high energy microwaves. The rotational movement causes the orientation of the particles with respect to the beam of microwaves to change and promotes mixing of the particles in the housing, with a result that it is possible to have different orientations of particles exposed to microwaves and increased opportunities for all particles to be exposed to microwaves. In overall terms, the screw feeder apparatus makes it possible to effectively control the exposure of the crushed bauxite ore particles to microwave energy and, more particularly, to ensure that there is uniform treatment of the particles.

In addition, the use of high energy pulsed microwave energy minimises the risk of undue heating of the crushed bauxite ore particles that may be detrimental.

Control of the treatment of crushed bauxite ore particles can readily be achieved by adjusting one or more of the rate of rotation of the screw feeder, the energy of the pulsed microwave energy, the duration of the pulses, the time period between pulses, and the packing density of minerals in the housing.

The treated crushed bauxite ore particles discharged from the outlet end of the housing are transferred to downstream operations for further processing, as required.

Many modifications may be made to the present invention as described above.

The microwave treatment apparatus described in relation to the flow sheet includes a single assembly of a microwave source and a screw feed apparatus. The present invention is not so limited and extends to arrangements in which there is a series of the assemblies and the treated material from each upstream assembly is transferred successively to downstream assemblies. With this arrangement, it may be the case that each assembly exposes a relatively small proportion of the ore particles to microwave energy and that the overall result is that substantially all of the particles are exposed to microwave energy.

The invention claimed is:

1. A method of treating minerals using microwave energy that includes a step of exposing mineral particles to pulsed high energy microwave energy while the particles are in a moving mixed bed that mixes the particles so that at least substantially all particles receive at least some exposure to microwave energy, wherein the duration of the pulses of microwave energy is less than 0.001 second.

2. The method defined in claim 1, wherein the energy of the microwave energy is at least 20 kW.

3. The method defined in claim 2, wherein the energy of the microwave energy is at least 50 kW.

4. The method defined in claim 1, that further includes controlling the energy and/or the duration of the pulses of microwave energy to ensure that individual particles are not overly exposed leading to undesirable heating of particles and/or the apparatus.

5. The method defined in claim 1, wherein the time period between successive pulses of microwave energy is 10-20 times the pulse time period.

6. A method of recovering valuable components, such as a metal, from a mineral that includes the steps of:

(a) treating minerals in accordance with the method defined in claim 1 and producing treated minerals; and (b) processing the treated minerals and recovering one or more than one valuable component from the treated minerals.

7. The method defined in claim 6, wherein step (a) includes causing physical and/or chemical changes in minerals resulting in conversion of at least a part of the minerals to a gas phase and subsequent release of the gas phase from the minerals.

8. The method defined in claim 7, wherein step (a) includes causing physical and chemical changes in the form of conversion of chemically-bound water in minerals to water vapour and subsequent release of the water vapour from minerals.

* * * * *